United States Patent [19]

Blackmon

[11] Patent Number: 4,480,744

[45] Date of Patent: Nov. 6, 1984

[54] MULTI-SECTIONED STORAGE CASE

[76] Inventor: Laura M. Blackmon, 420 San Saba, El Paso, Tex. 79912

[21] Appl. No.: 447,707

[22] Filed: Dec. 7, 1982

[51] Int. Cl.[3] ..... B65D 3/04; B65D 69/00

[52] U.S. Cl. ..... 206/1.7; 206/45.34; 206/1.8; 312/245; 312/138 A

[58] Field of Search ..... 206/45.34, 570, 1.7, 206/566, 1.8, 1.9; 190/16; 312/245, 138 A, DIG. 33

[56] References Cited

U.S. PATENT DOCUMENTS

| | | | |
|---|---|---|---|
| D. 184,180 | 12/1958 | Levey | 312/138 A |
| 1,254,132 | 1/1918 | Garman | 312/245 |
| 1,663,820 | 3/1928 | Sykes | 312/245 |
| 1,984,345 | 12/1934 | Kennedy | 312/DIG. 33 |
| 2,683,363 | 8/1954 | Falk et al. | 312/DIG. 33 |
| 2,739,863 | 3/1956 | Ferris | 312/DIG. 33 |
| 2,867,928 | 1/1959 | Angell | 206/1.8 |
| 3,446,337 | 5/1969 | Blackmon | 206/1.7 |
| 3,878,939 | 4/1975 | Wilcox | 206/459 |
| 4,324,446 | 4/1982 | Le Sage | 206/45.34 |

*Primary Examiner*—William T. Dixson, Jr.
*Assistant Examiner*—Brenda J. Ehrhardt
*Attorney, Agent, or Firm*—James J. Brown

[57] ABSTRACT

A multi-sectioned hinged case is provided which is specifically adapted to facilitate the storage and retrieval of numerous articles of differing size and configuration. When open the case is adapted to stand upright securely with its respective sections both visible and accessible. When closed the sections fold together to form a unitary case. In one embodiment of the invention one of the sections is provided with a removable bin which projects beyond the sides of that section and is provided with a corresponding vacant area in an adjacent section of the case to accommodate the projecting bin when the case is closed. The multi-section hinged case of the invention is particularly adapted for the storage, display and retrieval of fishing tackle, sewing implements and artist's supplies.

12 Claims, 6 Drawing Figures

MULTI-SECTIONED STORAGE CASE

SUMMARY OF THE INVENTION

The present invention is directed to a folding case for storage of small articles and more particularly to a case which may have two or three hinged upright container sections which fold together to provide closure of the case. The invention is further characterized by permitting upright display of and easy access to the articles contained in the case when it is opened and disposed in its normal upright position.

BACKGROUND OF THE INVENTION

Orderly storage and ease of access to small implements and materials used in occupational or recreational activities can be a significant factor both in the enjoyment and efficiency of that activity. Many of the cases or kits which have in the past been provided are essentially nothing more than boxes which are compartmentalized to one extent or another to facilitate the storage of small implements but without much attention being given to the accessibility or visibility of the stored items. This can result in a considerable amount of lost time and effort as well as frustration when it is desired to retrieve these items particularly when this is done at a time when one is otherwise occupied such as in the pursuit of the recreational or occupational activity in which these items are to be used. For example, the fisherman who is actively engaged in that sport either ashore or in a boat may find it inconvenient to be distracted from his fishing by having to sort through multiple layers of his tackle box of conventional design to try to locate items of immediate needs. Similarly, the seamstress may find it distracting and frustrating when that person must stop sewing to look through a typical "stacked" sewing box to find a particular spool of thread or instrument that may in fact be stored at the very bottom of the box. Similar problems of accessibility and visibility are encountered by individuals in many other fields in which a large number of relatively small items may be required from time to time.

In my previous patent, Ser. No. 3,446,337 I described an artist's supply case having the principal advantages of providing a display of the various artist's implements as well as ease of accessibility to these instruments. The artist's case therein described is further provided with an artist's palette, brush holders and provision for neatly storing the various paints and solvents which are required.

It is an object of the present invention to provide a case adapted for the storage of small articles which comprises multiple upright sections or containers which are hinged together so that the case can be opened to present an orderly and visible display of the articles contained therein.

It is a further object of the present invention to provide a storage case which is uniquely compartmentalized to facilitate the storage of numerous articles of differing size and shape while still facilitating access to these articles.

Yet another object of the present invention is to provide a compartmentalized storage cabinet which is uniquely adapted to be disposed in an open, stable, upright position to provide ease of access and visibility to the articles stored therein.

DESCRIPTION OF THE INVENTION

The above and other objects are achieved in accordance with the present invention wherein there is provided a multi-section, hinged case specifically adapted to facilitate the storage and retrieval of numerous articles of differing size and configuration. In accordance with the present invention a storage case is provided which folds into a closed unitary structure but which, when opened, is adapted to stand upright securely with its respective sections opened and visible to permit ease of access to the contents thereof. The case of the present invention consists of two or three sections of upright rectangular containers two of which are hinged on opposing edges to the third centrally disposed section and form a cover for the central container when folded over. A particularly unique feature of the present invention is the provision in one of the outside sections of a removable bin which actually projects beyond the sides of that section a distance no greater than the depth of the central container, which is provided with a vacant section to accommodate the projecting portion of the bin when the outside section is closed to form a cover over the central section. Additionally, the sections or containers of the case of the present invention can be provided with sliding drawers that are uniquely constructed so that they will not slide all the way out of the unit. In yet another embodiment of the present invention one section of the case is provided with horizontally disposed shelves and a cover is hinged on that section to provide a closure for the shelves to prevent the articles on the shelves from falling out. In yet another embodiment of the present invention a palette and means for holding brushes can be provided to facilitate storage of artist's supplies.

Further advantages and features of the present invention will however become apparent by having reference to the following detailed description of the drawings.

DETAILED DESCRIPTION OF THE DRAWINGS

Figure 1:
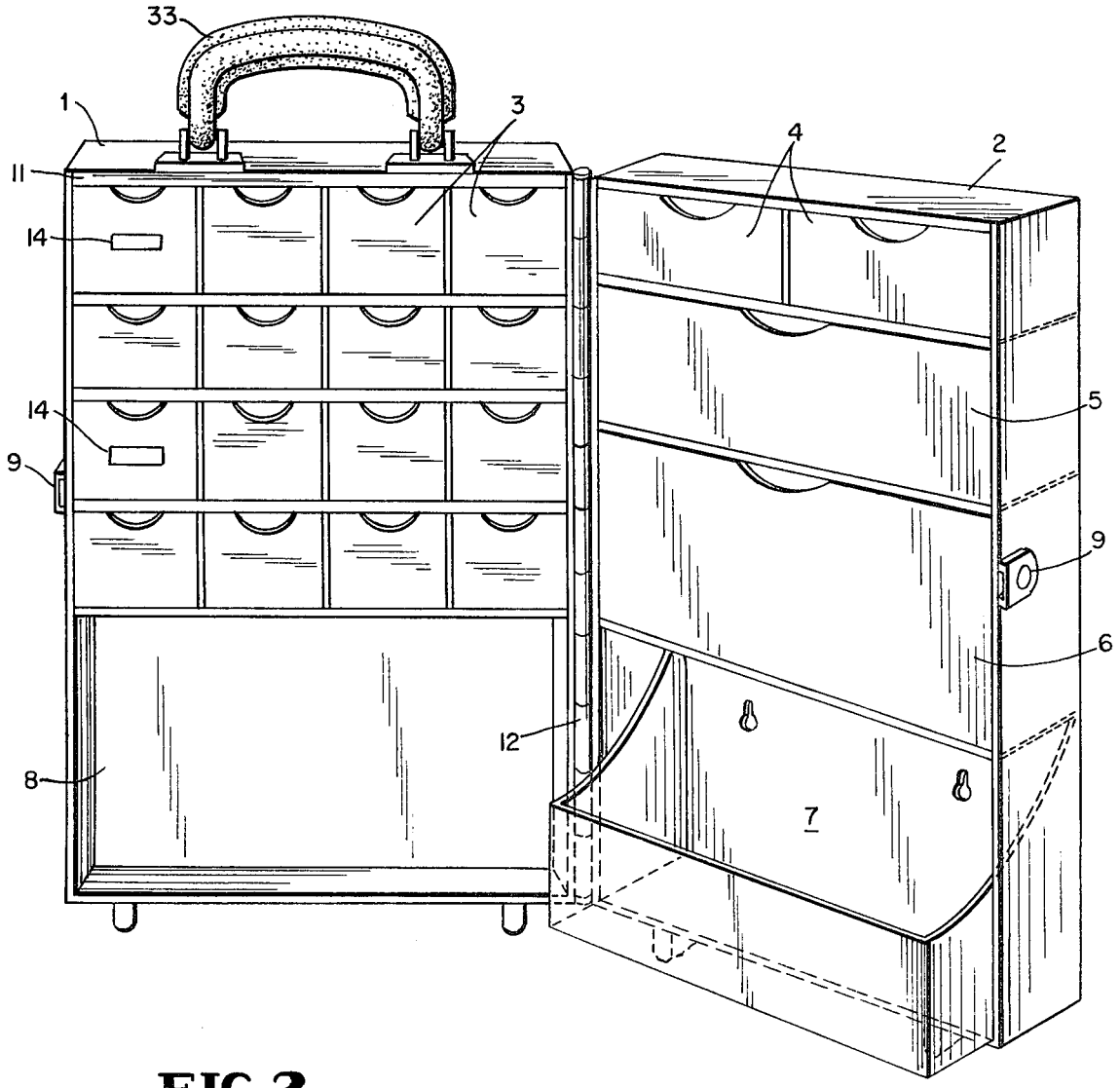
FIG. 1 is a front perspective view of an open two section case of the present invention.
Figure 2:
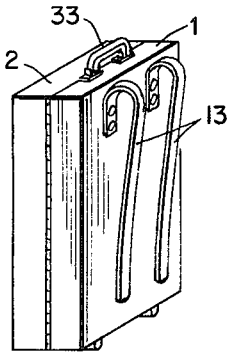
FIG. 2 is a perspective view of the closed case of FIG. 1.
Figure 3:
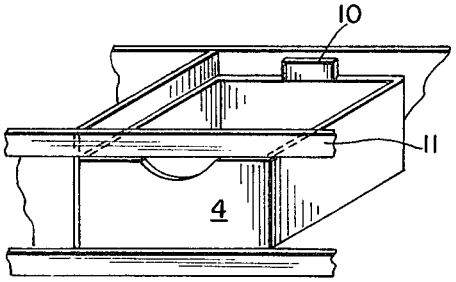
FIG. 3 is a detailed perspective view of one of the drawers shown in FIG. 1.

Directing attention to FIG. 1 of the drawings, a left hand section 1 and a right hand section 2 are hinged together at 12 to provide the folding storage case of the present invention. FIG. 2 of the drawings illustrates the two section case of FIG. 1 when in its closed configuration. The left hand section 1 is provided with a handle 33 and a plurality of sliding drawers 3 which conveniently have labels 14 to identify the contents of the drawers. A vacant space 8 is provided in the lower portion of section 1 to accommodate a removable bin 7 which is disposed opposite the vacant section 8 in section 2 of the case. Additional drawers are provided at 4, 5 and 6 in section 2 and are conveniently of different sizes to accommodate different size articles. The bin 7 actually projects outward from section 2 of the case a distance which is about equal to the depth of section 1 of the case so that it will fit into the vacant space 8 when the two units are closed together. A latch 9 is provided to hold the two sections together in their closed configuration. In FIG. 2 of the drawings a pair of hangers or brackets 13 are shown attached to the back of the closed case to permit it to be suspended in an upright position from a planar surface. This is particularly advantageous when the case of the present invention is used for example to store fishing equipment since it permits the case to be attached to the inside of a boat where it is readily available to the fisherman and can be opened in an upright position. FIG. 3 of the drawings illustrates in detail one of the drawers 4 of the invention in which a tab 10 is provided at the back of one drawer to prevent the drawer from being withdrawn from its compartment. When the drawer is pulled outward, the tab 10 will engage the strip 11 to restrain the drawer from further forward movement unless it is tilted upward.

Figure 4:
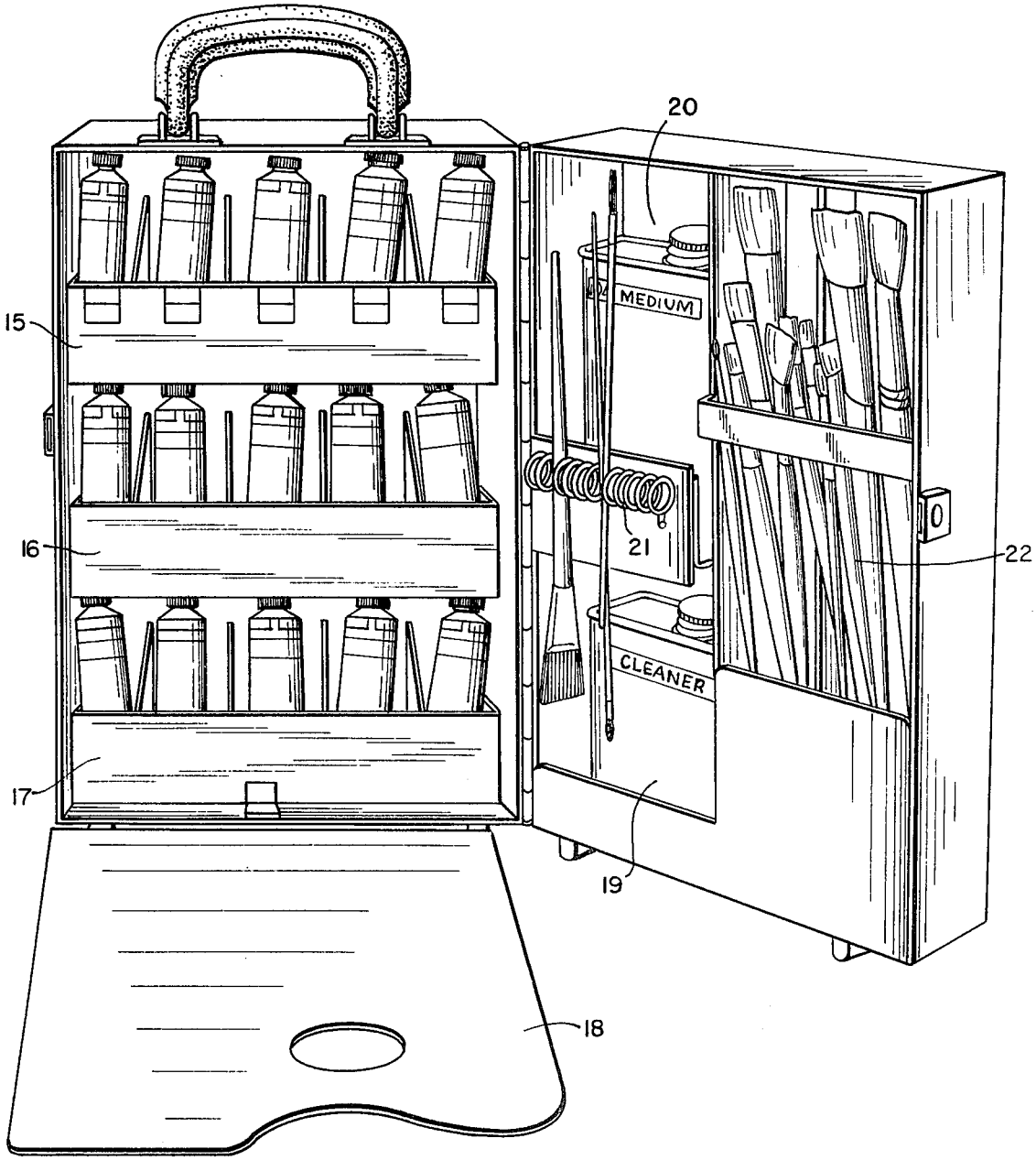
FIG. 4 is a perspective view of an open two section case of the present invention specifically adapted for artist's supplies.

In FIG. 4 of the drawings a two section case similar to that shown in FIG. 1 of the drawings is illustrated but specifically adapted for the storage and display of artist's materials. In the illustrated embodiment of the invention, horizontal sectioned bins 15, 16 and 17 are provided in the left hand section with artist's palette 18 that is clipped to the left section and can be removed for use or placed over the storage bins when the case is closed. In the right hand section a spring clip 21 is provided for holding brushes and two sections 19 and 20 for larger quantities of material such as solvents. A further tall bin 22 is provided for the storage of brushes or other tall articles.

Figure 5:
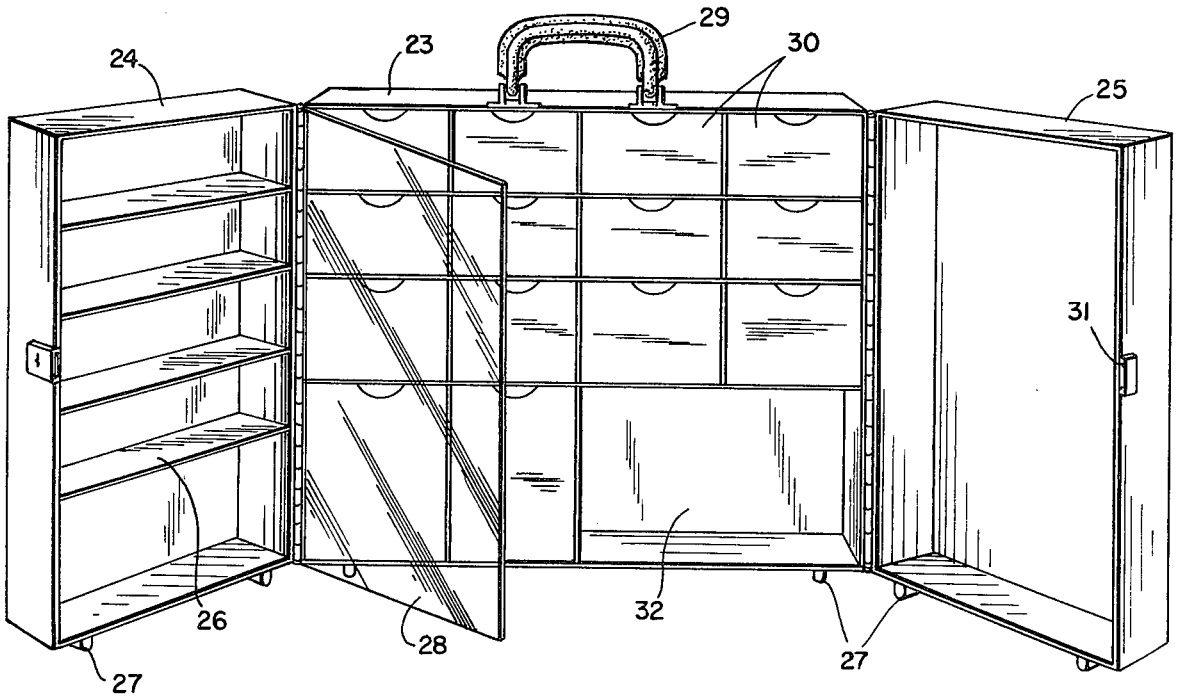
FIG. 5 is a perspective view of a three compartment case having shelves in the left hand compartment.

FIG. 5 of the drawings illustrates the embodiment of the present invention wherein three sectionalized, upright container sections 23, 24 and 25 are hinged together to provide the closed unitary case of the present invention. The central section 23 has hinged to it a right hand section 25 and a left hand section 24. These two sections close together to form a cover for the central section 23. Although not specifically indicated in the drawings, the right hand section or container 25 is conveniently provided with drawers and a removable bin as shown for the right hand section 2 in FIG. 1 of the drawings. Similarly, the central section 23 is provided with a vacant space 32 to accommodate the removable bin in the lower portion of section 25. Drawers 30 occupy the remainder of the space in section 23 and are constructed as illustrated in FIGS. 1 and 3 of the drawings. The left hand section of the case 24 is shown provided with a plurality of shelves 26 and a hinged transparent door 28 which folds over the open section 24 and latches to provide a cover that restrains the contents of the shelves 26 from sliding off. A handle is shown at 29 and feet at 27. The two outside sections 24 and 25 when folded over the central section 23 are latched together by means of a latch 31 to provide a cover for the entire unit.

Figure 6:
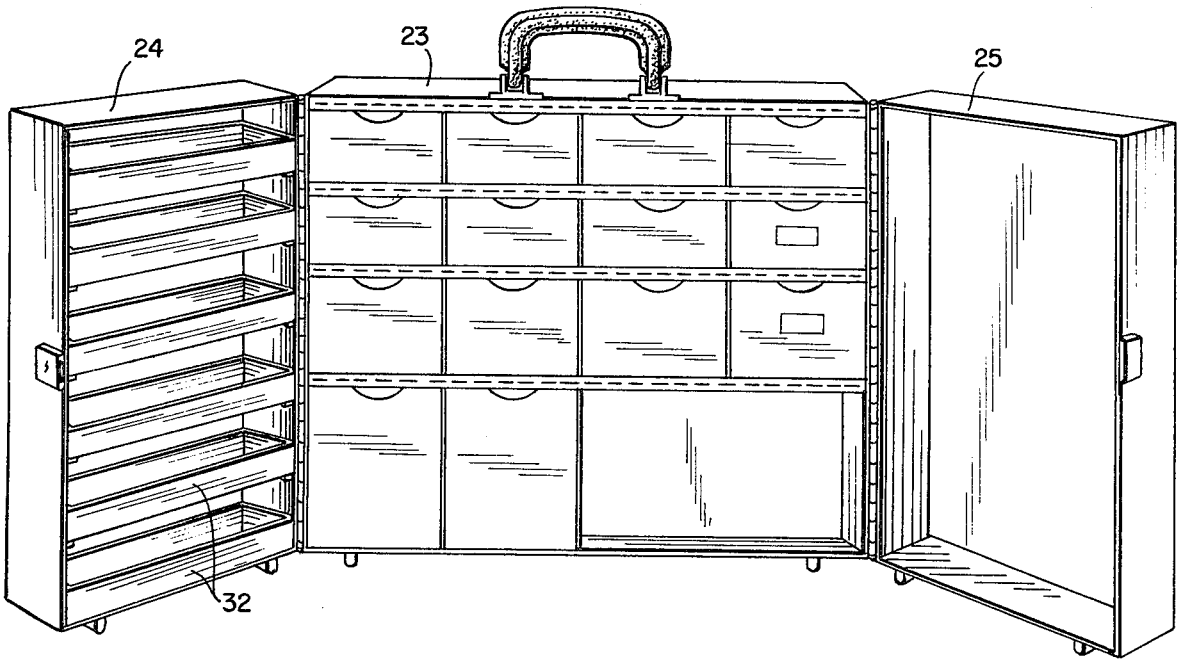
FIG. 6 is a front perspective view of a three section case in which a series of drawers is provided in the left hand section.

Directing attention to FIG. 6 of the drawings, there is illustrated an additional three section case having substantially the same configuration as shown in FIG. 5 of the drawings except that the left hand section 24 is provided with a series of horizontally extending drawers 32 rather than the shelves shown in FIG. 5. In this instance, the cover door 28 is not required since the drawers themselves provide sufficient retention of the articles placed therein.

It will be appreciated that the folding case of the present invention in its various configurations finds utility for the storage, display and retrieval of a wide range of useful articles. For example the present invention can be used conveniently for storing sewing materials such as thread, scissors, and needles. Additionally, the folding case of the present invention can be used to great advantage by fishermen for the storage of the numerous accoutrements of that sport. Workmen and tradesmen will also find the case of the present invention to be of great convenience in the storage of numerous small implements and articles which they constantly must have access to.

It will further be appreciated that advantageously the various drawers, shelves and inside covers employed in the storage case of the invention are constructed of clear material such as plastic to enhance the visibility of the articles stored inside. Other materials may however be used or substituted as the situation dictates. Further modifications and variations will also be apparent to those of ordinary skill in the art and are considered by the inventor to constitute a part of the invention herein described and claimed.

What is claimed is:

1. A case adapted to storage of small articles comprising:

(a) a first open faced, upright rectangular section and two other upright, open faced rectangular sections hinged thereto and constituting together a cover for said first section with the open face thereof facing the sections constituting said cover, one of said other two sections having a plurality of horizontally extending receptacles and each of said three sections being an open enclosure having a back and four sides to form a rectangular cavity;

(b) the other of said sections which constitutes a cover being divided into a plurality of removable compartments, one of which is slidably disposed within the cavity thereof but projects outward beyond said cavity a distance not greater than the depth of said first section.

(c) said first section having a vacant area therein opposed to said outwardly projecting compartment and adapted to receive the projecting portion of said compartment when said other section is closed over the first section as a cover; said first section being further provided with a plurality of removable compartments in areas other than said vacant area.

2. The case of claim 1 wherein said removable compartments are drawers slidably disposed in their respective rectangular sections.

3. The case of claim 1 wherein said horizontally extending receptacles are shelves and said section in which they are disposed is provided with a cover which is hinged to one side of the section to provide a closure for the open face thereof.

4. The case of claim 1 wherein said horizontally extending receptacles are slidably disposed drawers.

5. The case of claim 2 wherein said drawers are provided with means to restrain complete removal from the compartment wherein they are disposed.

6. The case of claim 4 wherein said drawers are provided with means to prevent complete removal from the compartment wherein they are disposed.

7. A case adapted to storage of small articles comprising:

(a) two open faced upright rectangular sections the second of which is hinged to the first and constitutes a cover for said first section with the open face thereof facing the section constituting said cover both of said sections being an open enclosure having a back and four sides to form a rectangular cavity;

(b) the second of said sections being divided into a plurality of removable compartments, one of which is slidably disposed within the cavity thereof but projects outward beyond said cavity a distance not greater than the depth of said first section;

(c) said first section having a vacant area therein opposed to said outwardly projecting compartment and adapted to receive the projecting portion of said compartment when said second section is closed over the first section as a cover; said first section being further provided with a plurality of removable compartments in areas other than said vacant area.

8. The case of claim 7 wherein said removable compartments are drawers slidably disposed in their respective rectangular sections.

9. The case of claim 7 wherein said horizontally extending receptacles are shelves and said section in which they are disposed is provided with a cover which is hinged to one side of the section to provide a closure for the open face thereof.

10. The case of claim 7 wherein said horizontally extending receptacles are slidably disposed drawers.

11. The case of claim 7 wherein said drawers are provided with means to restrain complete removal from the section wherein they are disposed.

12. The case of claim 10 wherein said drawers are provided with means to prevent complete removal from the section wherein they are disposed.

* * * * *